US007100512B2

(12) United States Patent
Monetti et al.

(10) Patent No.: US 7,100,512 B2
(45) Date of Patent: Sep. 5, 2006

(54) TIMED PYRIC CHAIN APPARATUS, IN PARTICULAR FOR THE IGNITION OF PYROTECHNICAL FIREWORKS

(76) Inventors: Carlo Monetti, Via del Rosso, 84-58015, Orbetello (IT); Luigi Leone Paolo Monetti, Via del Rosso, 84-58015, Orbetello (IT)

( * ) Notice: Subject to any disclaimer, the term of this patent is extended or adjusted under 35 U.S.C. 154(b) by 0 days.

(21) Appl. No.: 11/020,274

(22) Filed: Dec. 27, 2004

(65) Prior Publication Data

US 2005/0257710 A1 Nov. 24, 2005

Related U.S. Application Data

(63) Continuation of application No. PCT/IT03/00393, filed on Jun. 24, 2003.

(30) Foreign Application Priority Data

Jun. 25, 2002 (IT) ..... GR2002A0002

(51) Int. Cl.
*C06C 5/06* (2006.01)

(52) U.S. Cl. ..... 102/275.12; 102/275.1; 102/276; 102/275.7

(58) Field of Classification Search ..... 102/275.1, 102/275.2, 275.3, 275.4, 275.5, 275.6, 275.7, 102/272.8, 275.11, 275.12, 276, 277.1
See application file for complete search history.

(56) References Cited

U.S. PATENT DOCUMENTS 3,326,127 A * 6/1967 Schimmel ..... 102/275.2
3,706,277 A * 12/1972 Willard et al. ..... 102/275.4
4,314,508 A 2/1982 Love
6,499,405 B1 * 12/2002 Ambrico ..... 102/275.7
6,655,289 B1 * 12/2003 Bornheim et al. ..... 102/202.12

FOREIGN PATENT DOCUMENTS

| | | |
|---|---|---|
| DE | 197 15 738 | 10/1998 |
| DE | 198 44 528 | 4/1999 |
| FR | 2 642 158 | 7/1990 |
| GB | 2 040 025 | 8/1980 |
| WO | WO 99/20975 | 4/1999 |

* cited by examiner

*Primary Examiner*—Michelle Clement
*Assistant Examiner*—Stewart Knox
(74) *Attorney, Agent, or Firm*—Young & Thompson

(57) ABSTRACT

A timed pyric chain apparatus, particularly for the ignition of pyrotechnical fireworks includes a main conduit (2) for a retard fuse (16) the main conduit (2) having lateral branch conduits (5). The apparatus consists of coupled modular elements, each modular element having a fuse holder (1) including a main conduit (2) in which a retard fuse (16) is to be placed. The main conduit is divided into a first portion (4), the cross section of the first portion (3) being smaller than the cross section of the second portion (4), the fuse holder further including a lateral branch conduit (5) for receiving a wick (17) retainer (11) for a part of its length. The wick is provided with a fire passing sheath (18), the coupling of a first fuse holder (1) to a second fuse holder (1') resulting from the introduction of the first portion (3) of the first fuse holder (1) in a second portion (4') of the second fuse holder (1').

16 Claims, 4 Drawing Sheets

Figure 1:
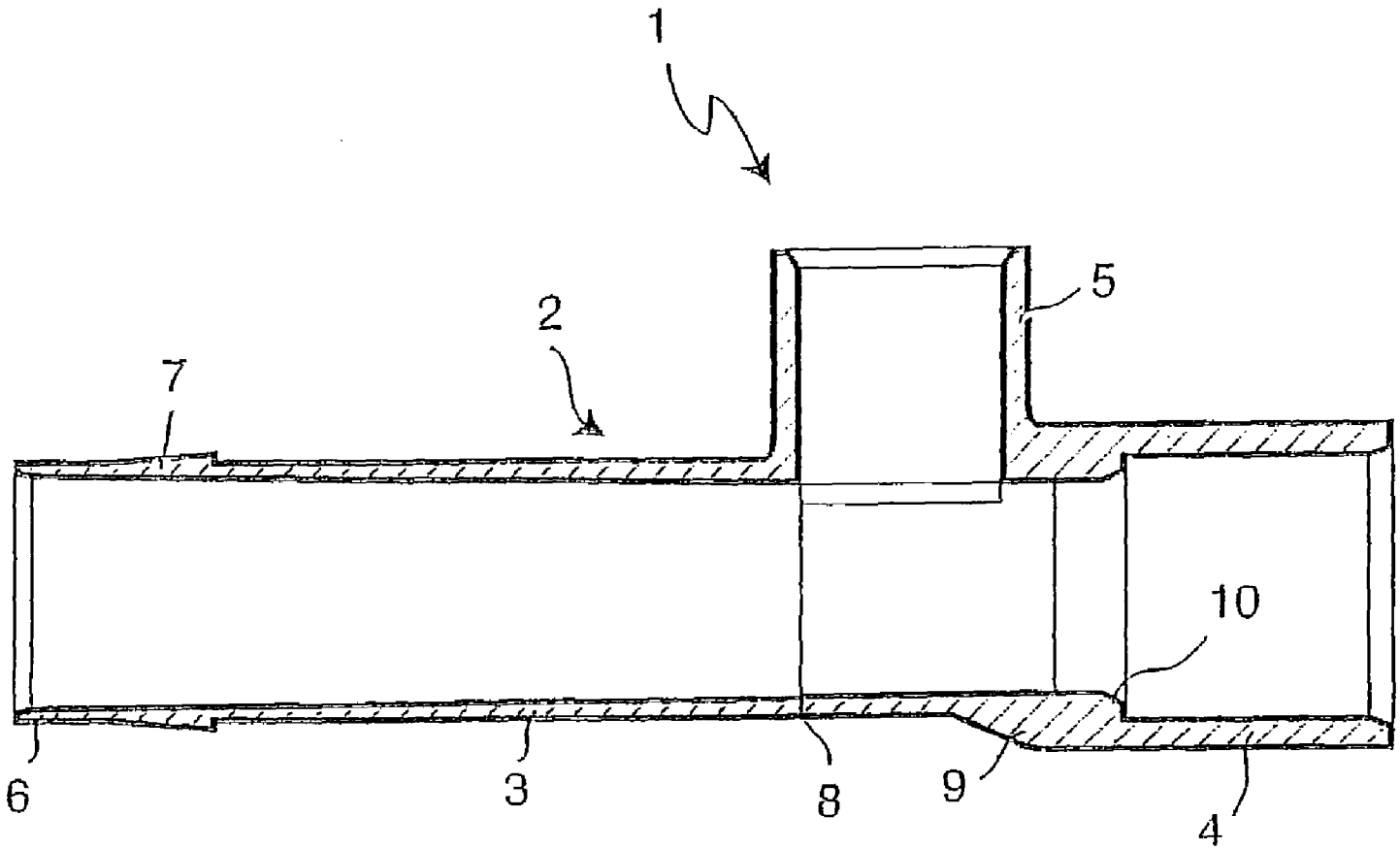

TIMED PYRIC CHAIN APPARATUS, IN PARTICULAR FOR THE IGNITION OF PYROTECHNICAL FIREWORKS

The present invention relates to a timed pyric chain apparatus, in particular for the ignition of pyrotechnical fireworks.

More particularly, the invention refers to a device able to guarantee the realisation of timed pyric chains for the ignition of pyrotechnical fireworks, by the use of traditional fuses or of length of safety fuse.

Ignition systems of pyrotechnical fireworks are based on the use of delay fuses and slow or quick matches, preferably covered by a sleeving. In case it is wished realising a pyrotechnical display, in which different kind of pyrotechnical fireworks are launched and exploded in succession, the different pyrotechnical fireworks are connected to each other in so-called timed pyric chains. The result obtained depends on the precision with which the intervals of ignition time between the individual pyrotechnical items are respected.

At present, timed pyric chains for the ignition of pyrotechnical fireworks are mainly comprised of a series of delay fuses connected to each other and to the fireworks to be ignited by slow or quick matches with a sleeving. Delay fuses are usually comprised of a cardboard tube containing compressed fine-grain black powder. Connections among the different delay fuses are usually comprised of slow matches or quick matches with sleeving, and employing paper and cord. These also have the function of preventing that the fine-grain black powdercan contact agents foreign to the chain and must withstand the mechanical stresses to which they are subjected during the combustion of quick matches.

Pyric chains of this kind have the drawback of requiring a lot of work to manufacture the delay fuses and to realise the connections with the quick matches by paper and cord. Further, with the pyric chains presently used it is not possible to set the wished combustion times with precision and regularity, this being a basic feature for the realisation of the choreography of a pyrotechnical display. Finally, the manufacturing of the delay fuses is quite dangerous.

Recently, different kinds of devices to solve these problems have been put on the market, but these, however, have some limitations. Particularly, a kind of fuse holder exists, shaped with three openings, one of which is designed to house the match connecting with the pyrotechnical fireworks and each one of the two remaining openings is designed to connect to an adjacent fuse holder of the same kind, by a delay fuse serving as connection and to transmit the ignition with a set time delay. However, this kind of solution requires the use of long delay fuses, with the consequent limitations of choice for the ignition time intervals between adjacent fireworks. Furthermore, delay fuses necessary for this kind of devices partially burn in an open space, being it possible that they cause "fire jumps", i.e. premature explosions, due to the ignition of uncovered fuses or matches, as a consequence of the contact with sparks caused by the combustion of fuses provided in other points of the pyric chains.

It would be much better to have at disposal a device able to allow the realisation of timed pyric chains in a very simple way, guaranteeing against the possibility that unwished phenomenons occurs, such as "fire jumps".

It is also known from WO 99 20975 A a timed pyric chain apparatus, particularly for the ignition of pyrotechnical fireworks, comprising a main conduit for a delay fuse, said main conduit having at least one lateral branch conduit.

This kind of solution permits to transmit the ignition in a timed pyric chain comprising as many matches connecting with corresponding pyrotechnical fireworks as the number of lateral branch conduits. However, this apparatus is not designed to permit coupling with other apparatuses of the same kind, except if long delay fuses are used, with the same limitations of the previously described solution.

In this context it is included the solution according to the present invention aiming to provide a device for the realisation of timed pyric chains, particularly for the ignition of pyrotechnical fireworks, realised in such a way as to protect the delay fuses from external agents, making at the same time useless the use of paper and cord or of other materials traditionally used for the connection of the ignition matches.

These and other results are obtained according to the present invention suggesting a modular device allowing to realise timed pyric chains simply coupling the wished number of elements to each other without using additional components.

It is therefore a specific object of the present invention a timed pyric chains apparatus, particularly for the ignition of pyrotechnical fireworks, comprising modular means for placing at least one delay fuse and/or at least a match part, said modular means being comprised of a fuse holder, said fuse holder comprising a main conduit and a lateral branch conduit, wherein said modular means are further comprised of means of clasping at least one quick or slow match (17), with the relevant sleeving (18), said main conduit being divided into a first portion and a second portion, the cross section of said first portion being smaller than the cross section of said second portion, thus allowing the fixed insertion of the first portion of the main conduit of a first fuse holder within the second portion of the main conduit of a second fuse holder, from said main conduit further branching said lateral branch conduit, said means of clasping being comprised of a quick match stopper that, after the insertion and clasping of at least one slow or quick match with the relevant sleeving, is fixed inserted, for a part of its length, within one of the conduits of the fuse holder.

Preferably, according to the invention, said main conduit and said lateral branch conduit have a circular cross section.

Still according to the invention, the extremity of the first portion of said main conduit is provided outside with a fin or enlargement, circumferentially provided on the outer surface of said main conduit, said fin preferably having a frustoconical shape, enlarging toward the second portion of the main conduit.

Further, always according to the invention, the first portion of said main conduit is innerly frustoconical shaped for all its length up to the beginning of the lateral branch conduit, very slightly tapering toward the second portion of the main conduit and can be provided with a ledge, close to the lateral branch conduit zone.

Preferably, always according to the invention, said first portion and said second portion are outside blended by a frustoconical narrowing and inside by a step.

Further, according to the invention, said quick match stopper has a substantially hollow cylindrical shape, with a open development section, and its lateral surface has a longitudinal cut, in a position opposed to the position of the opening in its section, said longitudinal cut extending about for half of its length, starting from one of its ends, thus defining two arms.

Furthermore, still according to the present invention, lateral surface of said arms is provided with two frustoconical shaped fins, circumferentially provided along the surface of the arms faced toward the outside portion of the quick match stopper.

Preferably, according to the invention, the lateral surface of said quick match stopper has a folding line in a position opposed with respect to the position of the opening in the section.

Preferably, according to the present invention, the timed pyric chain apparatus is comprised of flexible plastic material, even more preferably of transparent or semi-transparent material.

They are further a second and a third specific objects of the present invention a fuse holder and a quick match stopper as described in the above.

Figure 2:
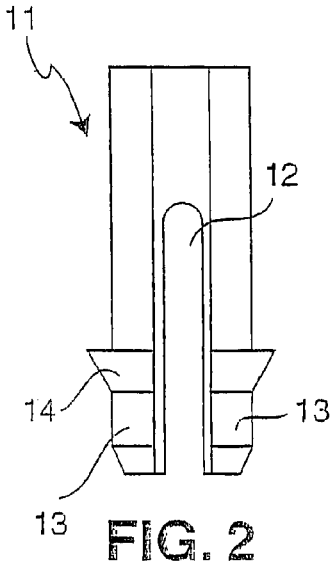
Figure 5:
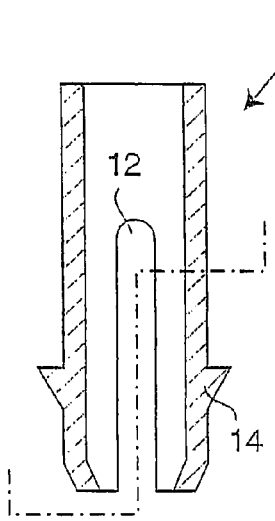
Figure 3:
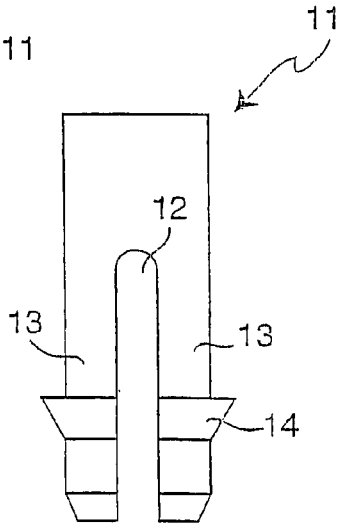
Figure 4:
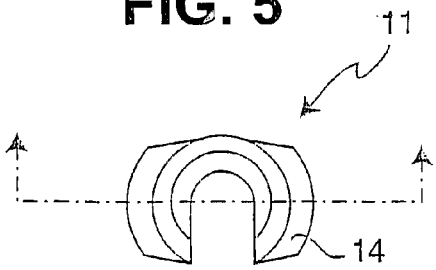
Figure 6:
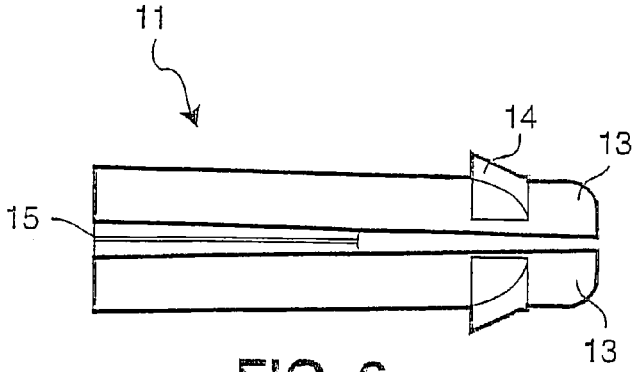
Figure 7:
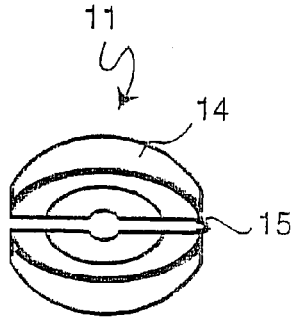
Figure 8:
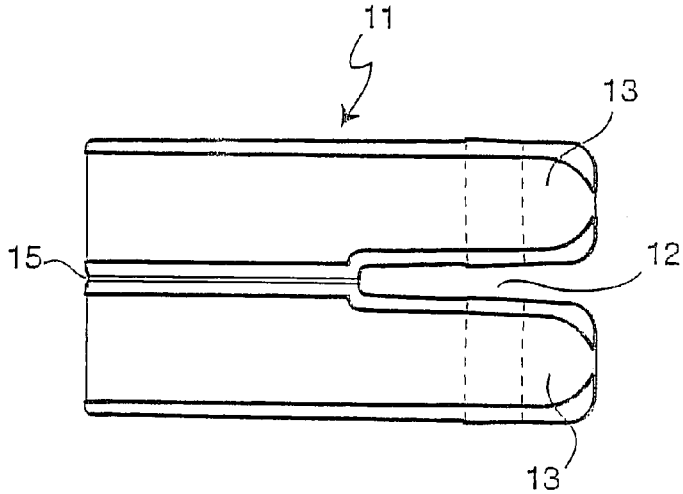
Figure 9:
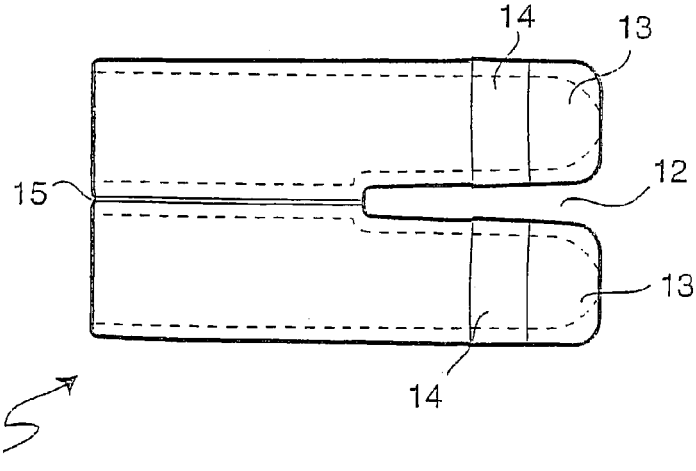
Figure 10:
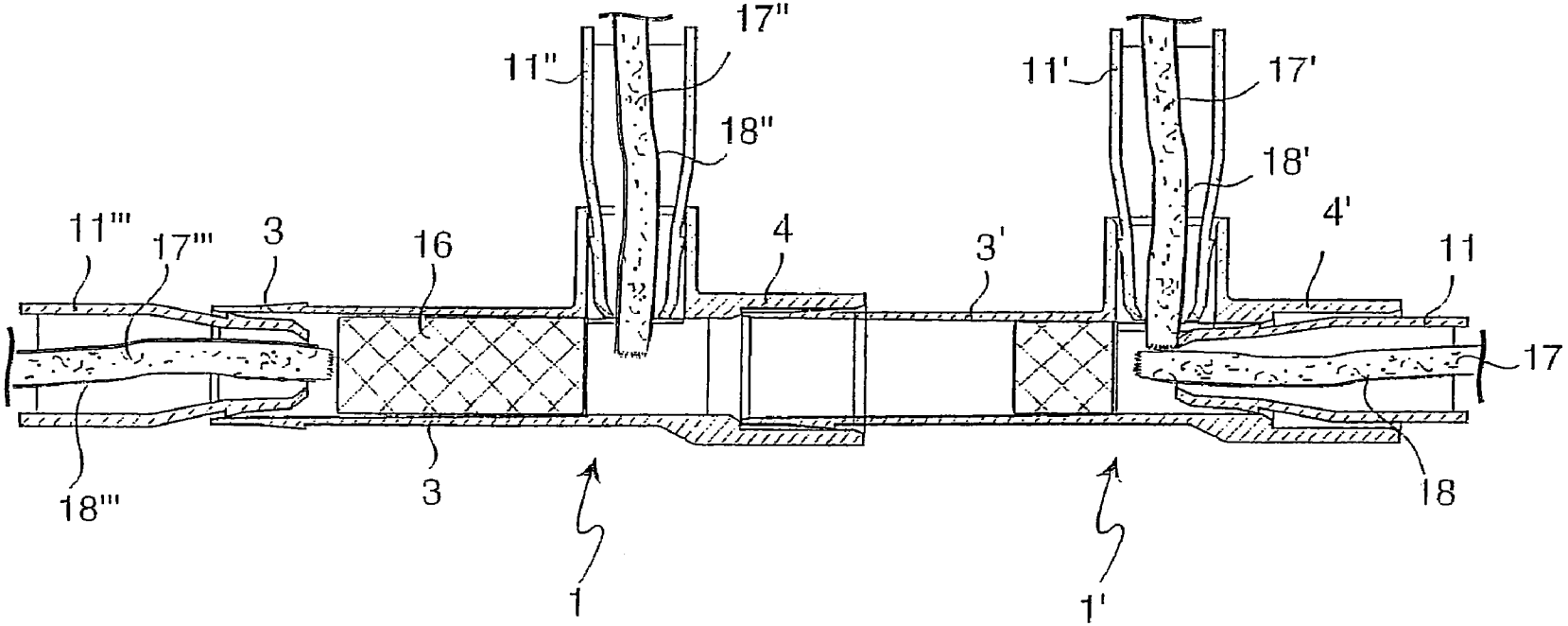

The present invention will be now described, for illustrative but not limitative purposes, according to its preferred embodiments, with particular reference to the figures of the enclosed drawings, wherein:

FIG. 1 shows a section view of the fuse holder according to the present invention, FIG. 2 shows a lateral view, from the opening line side, of a first embodiment of the quick match stopper according to the present invention, FIG. 3 shows a lateral view of the side opposite to the side of the opening line of the quick match stopper of FIG. 2, FIG. 4 shows a front view of the quick match stopper of FIG. 2, FIG. 5 shows a section view of the quick match stopper of FIG. 2, FIG. 6 shows a lateral view, from the opening line side, of a second embodiment of the quick match stopper according to the present invention, in a closed position, FIG. 7 shows a front view of the quick match stopper of FIG. 6, in a closed position, FIG. 8 shows a lateral view from the inner side of the quick match stopper of FIG. 6, in an open position, FIG. 9 shows, a lateral view from the outer side of the quick match stopper of FIG. 6, in an open position, FIG. 10 shows a timed pyric chain apparatus realised according to the present invention.

Making first reference to the figure 1, it is shown how the fuse holder 1, preferably comprised of semi-transparent plastic material, comprising a main conduit 2, divided into a longer and narrower first hollow cylindrical portion 3, and a shorter and larger second hollow cylindrical portion 4. Fuse holder 1 further provides a cylindrical shaped hollow lateral branch conduit 5, branching from the main conduit 2.

Extremity 6 of the first portion 3 of the main conduit 2 is outside provided with a fin 7, obtained shaping the outer surface of the first portion 3, all along its circumference and for a part of its length, having a frustoconical shape, enlarging toward the opposed extremity of the main conduit 2. Inner surface of the first portion 3 has a frustoconical shape, all along its length up to the beginning of the lateral branch conduit, very slightly tapering in a direction toward the opposed extremity of the main conduit 2. Inner surface of the first portion 3 further provides a ledge 8, close to the zone of the lateral branch conduit 5.

Second portion 4 of the main conduit 2 is larger than the first portion 3. Particularly, diameter of the inner surface of the second portion 4 is such to allow the coupling, by fixed insertion, with the outer surface of the first portion 3 of the main conduit 2 of a second similar fuse holder.

Coupling between the inner and outer sections of the first portion 3 and of the second portion 4 of the main conduit 2 is realised by a frustoconical narrowing 9, and inside by a step 10.

Lateral branch conduit 5 has inner and outer dimensions very similar to those of the first portion 3 of the main conduit 2.

FIGS. 2–5 show a first embodiment of the quick match stopper 11, having a substantially hollow cylindrical shape with an open development. Quick match stopper 11 is also preferably comprised of plastic material. In a position opposed to that of the opening, lateral surface of the quick match stopper 11 extends for about half of its length, thus defining two arms 13. Lateral surface of the arms 13 is provided with two fins 14 having a frustoconical shape, circumferentially placed along the surface of the arms 13 faced outward. Radial dimensions of the quick match stopper 11 are such to allow a fixed insertion both inside and outside the first portion 3 of the main conduit of the fuse holder 1 and of the lateral branch conduit 5, as well as in correspondence of the step 10 of the second portion 4 of the main conduit 2.

FIGS. 6–9 show a second embodiment of the quick match stopper 11, which is different with respect to the first one for the presence of a folding line 15 along the same direction of the cut 12, for the remaining part of the lateral surface of the quick match stopper 11. Presence of the folding line 15, beside making the quick match stopper 11 more suitable for different sizes of quick matches, allows to realise the quick match stopper 11 much more easily by moulding.

FIG. 10 shows an example of a timed pyric chain realised by the apparatus according to the invention, coupling two fuses holders 1, 1' to each other and further using four quick match stoppers 11, 11', 11" and 11".

The realisation of the pyric chain provides that, first of all, the delay fuse 16 is placed within the fuse holder 1, by inserting through the hollow part of the first portion 3 of the main conduit 2 and pushing the same up to reaching the ledge 8. Frustoconical shape of the inner surface of the first portion 3 of the main conduit 2 acts in such a way to slightly and progressively compress the lateral surface of the delay fuse 16, preventing the unwished withdrawal of the same fuse.

Fuse holder 1, within which the delay fuse 16 is placed, can thus be coupled with the second fuse holder 1', already prepared placing within the same a second delay fuse 16', having the same or a different length with respect to the first one. Coupling between the two fuse holders 1, 1' occurs fixed inserting the first portion 3' of the main conduit 2' of the second fuse holder 1' within the second portion 4 of the main conduit 2 of the first fuse holder 1.

The timed pyric chain of FIG. 10 is further completed by four quick matches 17, 17', 17", 17", respectively provided with sleevings 18, 18', 18", 18", inserted within the relevant quick match stopper 11, 11', 11", 11".

Particularly, igniting the quick match 17, the latter transmits the flame to the quick match 17', that will make a first firework (not shown) starting, and to the delay fuse 16'. Once completed the combustion of delay fuse 16', flame is transferred to quick match 17" connected with a second firework (not shown) and to the second delay fuse 16. From the second delay fuse 16, flame is transferred to the quick match 17' and to a third firework (not shown).

Timed pyric chains realised according to the present invention can provide any number of fuses holders coupled to each other, according to the specific needing.

All the components of the device according to the present invention are preferably comprised of transparent or semi-transparent plastic material, in such a way to allow to verify the proper positioning of delay fuse 16 within the fuse holder 1.

It is well evident that the timed pyric chain apparatus according to the present invention is particularly versatile and easy to employ, solving all the technical problems of the known solutions.

Particularly, all the connections of the pyric chain are able to withstand the mechanical stresses occurring during the ignition.

Further, the fuse holder according to the present invention allows also to use delay fuses comprised of safety fuses long 10 mm or more and thus the realisation of very precise timed pyric chains, with time starting from 1 second for each delay fuse.

In the pyric chain obtained by the apparatus according to the present invention, being the measures of the pieces suitably studied, delay fuses are at a maximum distance such to guarantee that the flame of each match part can always ignite the following one. In this way, the pyric continuity of the chain is ensured.

In view of the modularity of the device, it is possible to realise pyric chains providing each number of elements, without the help of further materials, beside the fuses and the quick matches, with the relevant sleeving. Calibrated couplings further prevent the possibility that "fire jumps" occur.

Finally, the quick match stopper is able to conform within large tolerances to the imprecisions in the diameter of the quick match and of the relevant sleeving and to allow to fixed insert the same within any opening of the fuse holder.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A timed pyric chain apparatus for the ignition of pyrotechnical fireworks, comprising:

a first fuse holder and a second fuse holder, each of said first and second fuse holders comprising i) a main conduit for receiving one of a delay fuse and a match part, ii) said main conduit divided into a first portion having a first cross section and a second portion having a second cross section sized sufficiently larger than said first cross section such that a first portion of one of said fuse holders is fixedly insertable into a second portion of another of said fuse holders, iii) a lateral branch conduit extending from said main conduit; and a means for clasping a sleeved match, said means for clasping comprising a quick match stopper with at least a portion of said stopper fixedly insertable within either said main conduit or said lateral branch conduit.

2. The timed pyric chain apparatus according to claim 1, wherein said main conduit and said lateral branch conduit have a circular cross section.

3. The timed pyric chain apparatus according to claim 1, said first portion of said main conduit comprises a fin or enlargement circumferentially provided along the outer surface of said main conduit.

4. The timed pyric chain apparatus according to claim 3, wherein said fin has a frustoconical shape, enlarging toward said second portion of said main conduit.

5. The timed pyric chain apparatus according to claim 1, wherein said first portion of said main conduit is innerly frustoconical shaped for all its length up to the beginning of the lateral branch conduit and very slightly tapering toward the second portion of said main conduit.

6. The timed pyric chain apparatus according to claim 1, wherein said first portion of said main conduit comprises a ledge close to where said lateral branch conduit extends from said main conduit.

7. The timed pyric chain apparatus according to claim 1, wherein said first portion and said second portion are coupled by a frustoconically narrowing portion on the outer surface of said main conduit and a step on the inside surface of said main conduit.

8. The timed pyric chain apparatus according to claim 1, wherein said quick match stopper comprises a substantially hollow cylindrical shape having a lateral surface and an open development section.

9. The timed pyric chain apparatus according to claim 1, wherein said quick match stopper comprises:

a substantially hollow cylindrical shape having a lateral surface and an open development section, and a longitudinal cut along said lateral surface, in a position opposed to the position of said open development section, said longitudinal cut extending about half of the length of said cylindrical shape, starting from one end of the cylindrical shape, thus defining two arms.

10. The timed pyric chain apparatus according to claim 9, wherein said lateral surface of said arms comprises two frustoconical shaped fins, circumferentially provided along the surface of the arms faced toward the outside portion of the quick match stopper.

11. The timed pyric chain apparatus according to claim 8, wherein said lateral surface of said quick match stopper comprises a folding line in a position opposed with respect to the position of said open development section.

12. The timed pyric chain apparatus according to claim 1, wherein said apparatus comprises flexible plastic material.

13. The timed pyric chain apparatus according to claim 1, wherein said apparatus comprises transparent or semi-transparent material.

14. A fuse holder as defined in claim 1.

15. A quick match stopper as defined in claim 8.

16. The timed pyric chain apparatus according to claim 2, wherein said first portion of said main conduit comprise a fin or enlargement, circumferentially provided on the outer surface of said main conduit.

* * * * *